US011316300B2

(12) United States Patent
Sung

(10) Patent No.: US 11,316,300 B2
(45) Date of Patent: Apr. 26, 2022

(54) CONNECTOR ASSEMBLY AND ELASTIC ENGAGING COMPONENT

(71) Applicants: Inventec (Pudong) Technology Corporation, Shanghai (CN); INVENTEC CORPORATION, Taipei (TW)

(72) Inventor: Tai-Jung Sung, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 17/117,460

(22) Filed: Dec. 10, 2020

(65) Prior Publication Data

US 2022/0069516 A1 Mar. 3, 2022

(30) Foreign Application Priority Data

Sep. 2, 2020 (CN) ..... 202010907712.7

(51) Int. Cl.

| | |
|---|---|
| ***H01R 13/629*** | (2006.01) |
| ***H01R 13/40*** | (2006.01) |
| ***H01R 13/627*** | (2006.01) |
| ***H01R 13/506*** | (2006.01) |
| ***H01R 13/514*** | (2006.01) |

(52) U.S. Cl.

CPC ..... *H01R 13/629* (2013.01); *H01R 13/40* (2013.01); *H01R 13/506* (2013.01); *H01R 13/514* (2013.01); *H01R 13/627* (2013.01); *H01R 13/6275* (2013.01)

(58) Field of Classification Search

CPC .... H01R 13/40; H01R 13/506; H01R 13/514; H01R 13/627; H01R 13/629; H01R 13/6275

See application file for complete search history.

(56) References Cited

U.S. PATENT DOCUMENTS

| | | | | |
|---|---|---|---|---|
| 6,860,749 | B1 * | 3/2005 | Wu | H01R 13/6275 439/352 |
| 7,780,466 | B1 * | 8/2010 | Wu | H01R 13/6275 439/354 |
| 10,741,970 | B1 * | 8/2020 | Liu | H01R 13/506 |
| 10,886,649 | B1 * | 1/2021 | Yang | H01R 12/75 |
| 2020/0144752 | A1 * | 5/2020 | Liao | H01R 12/774 |
| 2020/0366019 | A1 * | 11/2020 | Hsiao | H01R 13/6275 |

* cited by examiner

*Primary Examiner* — Oscar C Jimenez

(74) *Attorney, Agent, or Firm* — Locke Lord LLP; Tim Tingkang Xia, Esq.

(57) ABSTRACT

A connector assembly includes a first electrical connector, a second electrical connector detachably plugged to the first electrical connector and an elastic engaging component including a mount part, a bent part, an arm part, an engaging part and a press part. The mount part includes an insertion plate configured to be inserted into the retaining groove and a movable plate connected to the insertion plate. The arm part is connected to the mount part via the bent part. The arm part and the mount part are located at the same side of the bent part. The engaging part is located at the arm part and is movable along with the arm part. the engaging part is configured to be engageable with the second electrical connector. The press part is connected to the arm part, and the arm part is movable by pushing the press part.

10 Claims, 9 Drawing Sheets

CONNECTOR ASSEMBLY AND ELASTIC ENGAGING COMPONENT

CROSS-REFERENCE TO RELATED APPLICATIONS

This non-provisional application claims priority under 35 U.S.C. § 119(a) on Patent Application No(s). 202010907712.7 filed in China, P.R.C. on Sep. 2, 2020, the entire contents of which are hereby incorporated by reference.

BACKGROUND OF THE INVENTION

Technical Field of the Invention

The present disclosure relates to a connector assembly and an elastic engaging component, more particularly to a connector assembly and an elastic engaging component that are easy to be plugged.

Description of the Related Art

As the electronic technology develops rapidly nowadays, various kinds of electronic devices, such as personal computers, notebook computers, tablet computers, and smartphones are widespreadly used, and they have become more powerful, lightweight, compact, and slim with the growing trend towards miniaturization. To transmit electrical signals, the devices have inbuilt connectors for different protocols. These connectors include jack connectors and plug connectors, and they were miniaturized as possible to meet the trend. With this requirement for the connectors, the space available for them to connect becomes very limited, making plugging connectors troublesome and inconvenient.

Further, some typical connectors can be connected to each other via the engagement of an elastic sheet with a mating hole, but the engagement may be easily released due to external force, resulting in disconnection of the device. Moreover, to those connectors used in hot-plug applications, their structures easily get cracked or damaged due to regular use.

As discussed, it is desired to develop a connector that can easily achieve a reliable plugging while having improved structural strength.

SUMMARY OF THE INVENTION

The present disclosure provides a connector assembly and an elastic engaging component, where the elastic engaging component is convenient to use and can achieve a reliable connection for the connector assembly. In addition, the elastic engaging component is well balanced between compact size and convenient use.

According to one aspect of the present disclosure, a connector assembly includes a first electrical connector, a second electrical connector, and an elastic engaging component. The first electrical connector includes a retaining groove and a first positioning protrusion. The first positioning protrusion is located adjacent to an opening of the retaining groove. The second electrical connector is detachably plugged to the first electrical connector. The second electrical connector includes a slot. The elastic engaging component includes a mount part, a bent part, an arm part, an engaging part and a press part. The mount part includes an insertion plate and a movable plate. The insertion plate is configured to be inserted into the retaining groove of the first electrical connector. The movable plate is connected to a side of the insertion plate. While the insertion plate is inserted into the retaining groove, the movable plate is configured to be deformed and moved with respect to the insertion plate by being pushed by the first positioning protrusion. When the insertion plate reaches a predetermined position, the movable plate is configured to return to an original position thereof and to be held by the first positioning protrusion of the first electrical connector or to be released from the first positioning protrusion by an external force to release a restriction relationship between the movable plate and the first positioning protrusion of the first electrical connector. The arm part is connected to the mount part via the bent part. The arm part is located at a side of the bent part wherein the mount part is located. The engaging part is connected to a side of the arm part located away from the mount part. The engaging part is movable with respect to the mount part along with the arm part, and the engaging part is configured to be engageable with the second electrical connector. The press part is connected to a side of the arm part located away from the bent part, and the arm part is movable with respect to the mount part by pushing the press part.

According to another aspect of the present disclosure, an elastic engaging component is configured to assemble a first mechanical component to a second mechanical component. The elastic engaging component includes a mount part, a bent part, an arm part, an engaging part and a press part. The mount part includes an insertion plate and a movable plate. The insertion plate is configured to be inserted into a retaining groove of the first mechanical component. The movable plate is located at a side of the insertion plate. The movable plate is movable with respect to the insertion plate, and the movable plate is configured to be held by the first mechanical component or to be released from the first mechanical component to release a restriction relationship between the movable plate and the first mechanical component. The arm part is connected to the mount part via the bent part. The arm part is located at a side of the bent part where the mount part is located. The engaging part is located at the arm part. The engaging part is movable with respect to the mount part along with the arm part, and the engaging part is configured to be engageable with the second mechanical component. The press part is connected to a side of the arm part located away from the bent part, and the arm part is movable with respect to the mount part by pushing the press part.

According to the connector assembly and the elastic engaging component discussed above, since the movable plate can be retained by the first positioning protrusion of the first electrical connector when no external force is applied thereon, the elastic engaging component is engageable with the first mechanical component or the first electrical connector.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
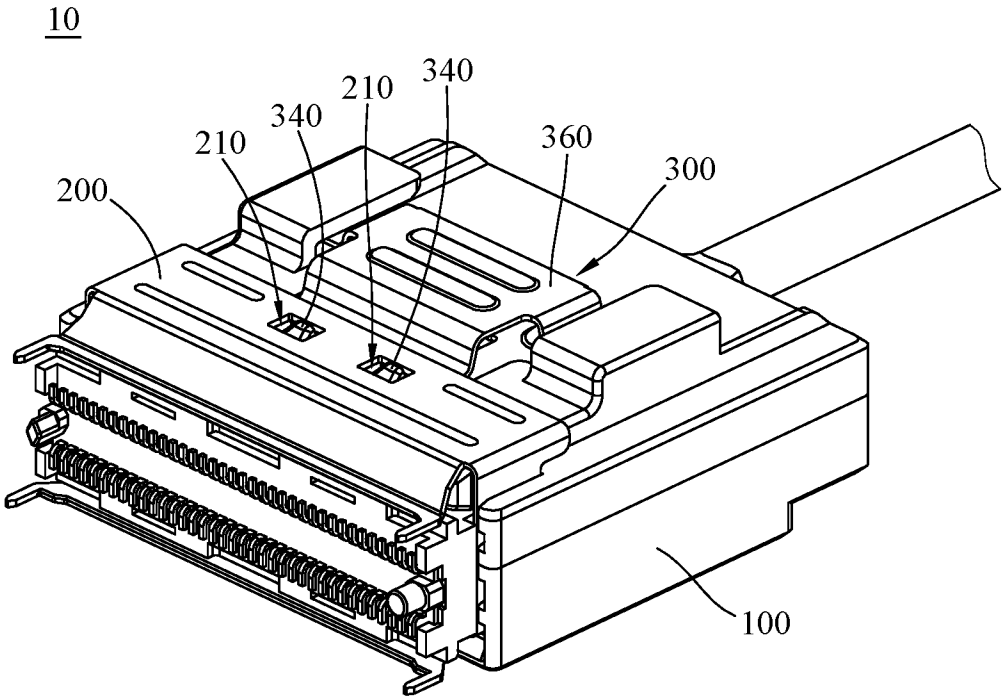
FIG. 1 is a perspective view of a connector assembly according to a first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
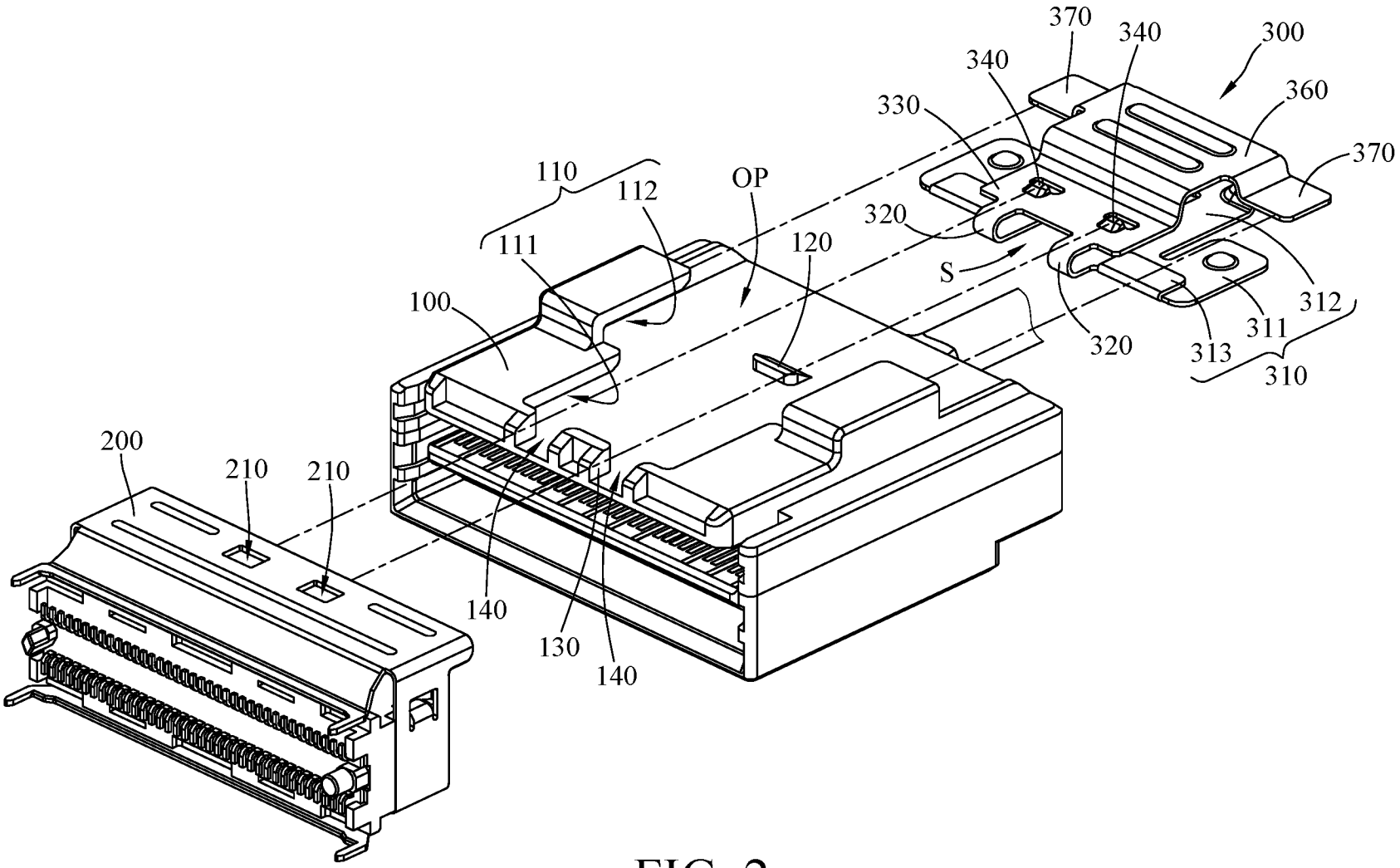
FIG. 2 is an exploded view of the connector assembly in FIG. 1.
Figure 3:
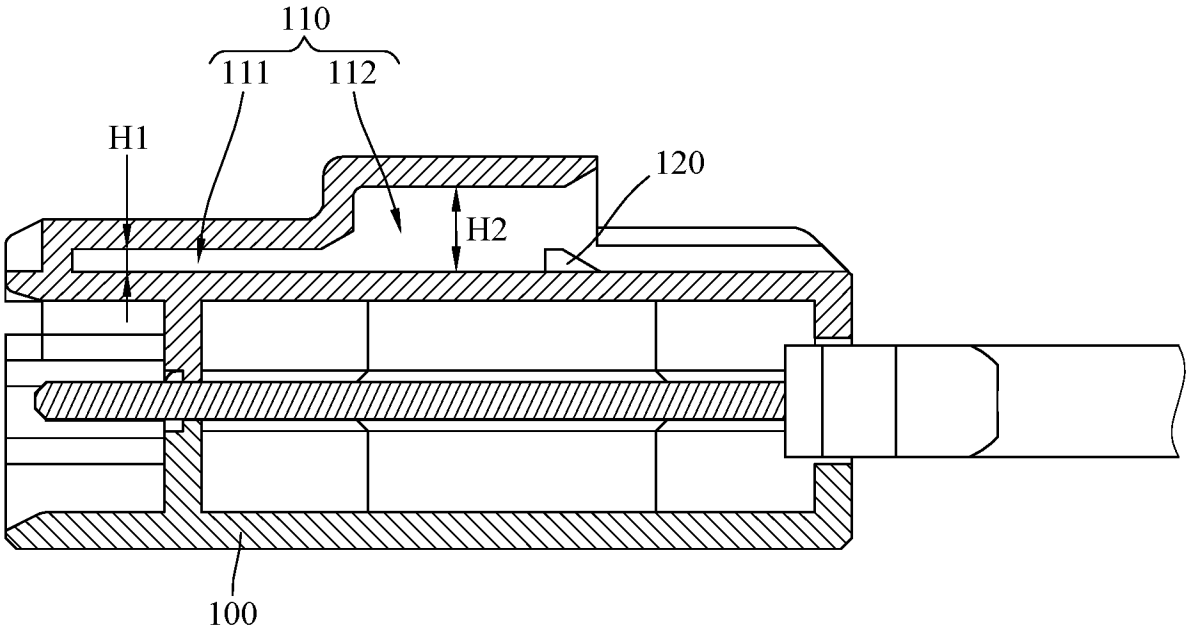
FIG. 3 is a cross-sectional view of a first electrical connector of the connector assembly in FIG. 2.
Figure 4:
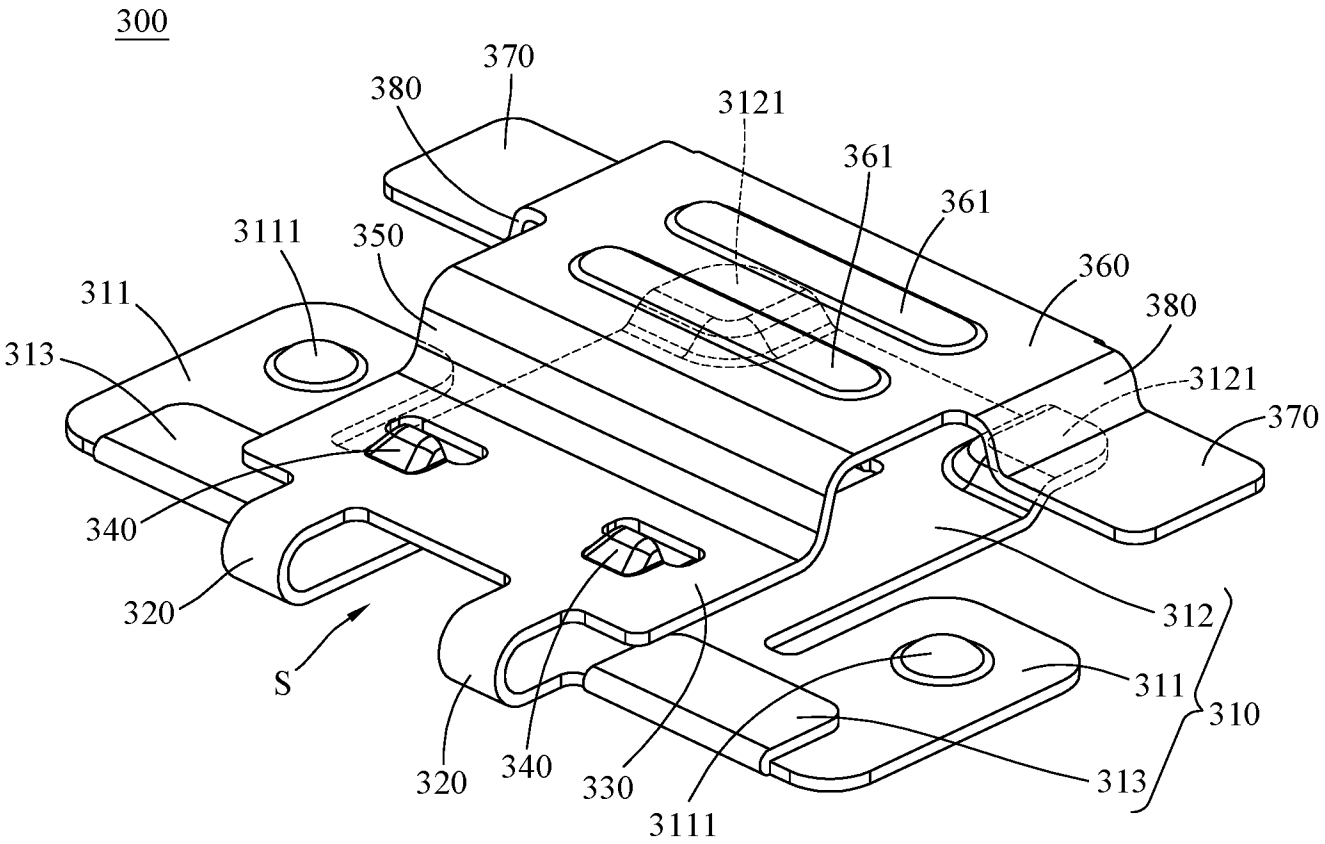
FIG. 4 is a perspective view of an elastic engaging component of the connector assembly in FIG. 2.
Figure 5:
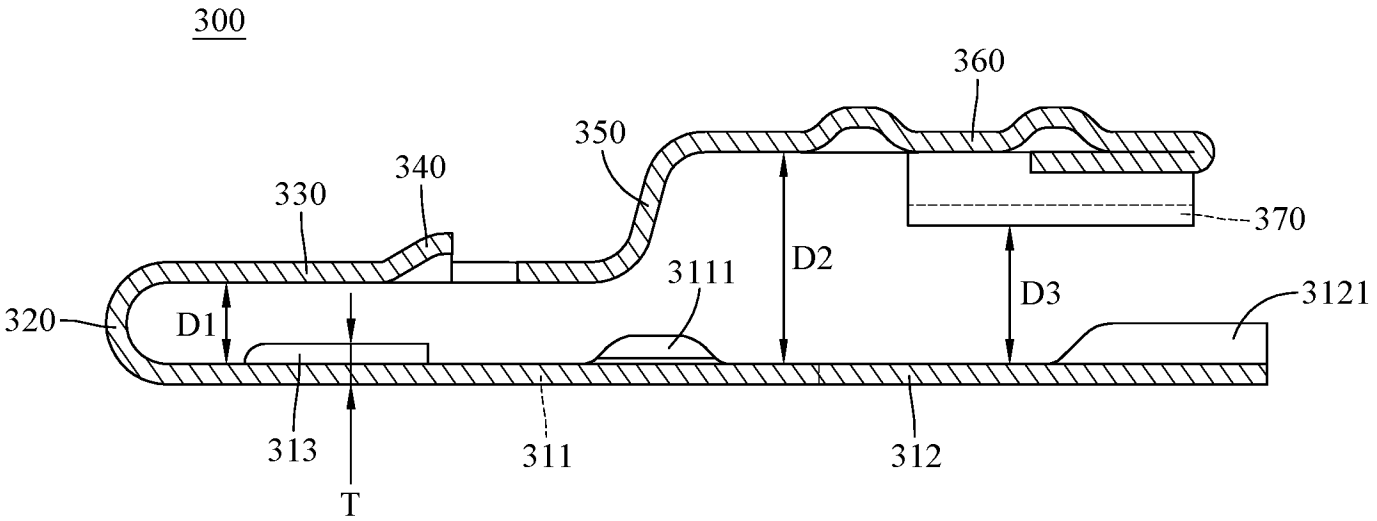
FIG. 5 is a cross-sectional view of the elastic engaging component in FIG. 4.

Please refer to FIG. 1 to FIG. 5, where FIG. 1 is a perspective view of a connector assembly according to a first embodiment of the present disclosure, FIG. 2 is an exploded view of the connector assembly in FIG. 1, FIG. 3 is a cross-sectional view of a first electrical connector of the connector assembly in FIG. 2, FIG. 4 is a perspective view of an elastic engaging component of the connector assembly in FIG. 2, and FIG. 5 is a cross-sectional view of the elastic engaging component in FIG. 4.

As shown, a connector assembly 10 is provided, the connector assembly 10 includes a first electrical connector 100, a second electrical connector 200, and an elastic engaging component 300.

The first electrical connector 100 is, for example, a signal plug. The first electrical connector 100 includes a retaining groove 110 and a first positioning protrusion 120. The retaining groove 110 includes a first retaining portion 111 and a second retaining portion 112. The first retaining portion 111 is located farther away from an opening OP of the retaining groove 110 than the second retaining portion 112; that is, the second retaining portion 112 is located between and connected to the first retaining portion 111 and the opening OP of the retaining groove 110. In FIG. 3, the first retaining portion 111 has a height H1, the second retaining portion 112 has a height H2, and the height H1 is smaller than the height H2. The first positioning protrusion 120 is located adjacent to the opening OP of the retaining groove 110; that is, the first positioning protrusion 120 is located adjacent to a side of the second retaining portion 112 located away from the first retaining portion 111.

In this embodiment, the first electrical connector 100 may further include a second positioning protrusion 130. The second positioning protrusion 130 and the first positioning protrusion 120 are respectively located adjacent to two opposite sides of the retaining groove 110. There are two gaps 140 respectively arranged at two opposite sides of the second positioning protrusion 130.

The second electrical connector 200 is, for example, a jack. The second electrical connector 200 is pluggable to the first electrical connector 100. The second electrical connector 200 includes two slots 210.

The elastic engaging component 300 may be formed by, for example, stamping and bending a metal plate. The elastic engaging component 300 includes a mount part 310, two bent parts 320, an arm part 330, two engaging parts 340, and a press part 360.

The mount part 310 includes two insertion plates 311 and a movable plate 312. The insertion plates 311 are configured to be inserted into the retaining groove 110 of the first electrical connector 100. The movable plate 312 is connected to and located between the insertions plates 311. The movable plate 312 is movable with respect to the insertion plates 311. The movable plate 312 can be retained by the first positioning protrusion 120 of the first electrical connector 100 when no external force is applied thereon. The movable plate 312 can be elastically deformed to move away from the first positioning protrusion 120 of the first electrical connector 100.

In this embodiment, the mount part 310 may further include two folded plates 313 respectively connected to and overlapping with the insertion plates 311. In FIG. 5, the folded plates 313 and the insertion plates 311 have a thickness T substantially equal to the height H1 of the first retaining portion 111 of the retaining groove 110. In addition, each of the insertion plates 311 may further include a bump structure 3111 protruding towards the arm part 330 from a surface of the insertion plate 311. The height of the bump structures 3111 is substantially equal to the height H1 of the first retaining portion 111 of the retaining groove 110. That is, the height of the bump structures 3111 is substantially equal to the thickness T of the folded plates 313 and the insertion plate 311. Accordingly, the first retaining portion 111 of the retaining groove 110 of the first electrical connector 100 can be a tight fit for the insertion of the insertion plates 311 via the folded plates 313 and the bump structures 3111.

In this embodiment, the quantities of the insertion plates 311 and the folded plates are exemplary and not intended to limit the present disclosure. In some embodiments, the mount part may only include one insertion plate and one folded plate.

The arm part 330 is connected to the mount part 310 via the bent parts 320, and the bent parts 320 are arranged on the same side of the arm part 330 and the mount part 310. The bent parts 320 are spaced apart from each other and form an accommodating space S therebetween. The bent parts 320 are configured to be respectively placed in the gaps 140 that are respectively located at two opposite sides of the second positioning protrusion 130. When the bent parts 320 are located in the gaps 140, the second positioning protrusion 130 is located in the accommodating space S and located between the bent parts 320. During the process of inserting the elastic engaging component 300 into the retaining groove 110, the elastic engaging component 300 can be stopped at the desired position as the arm part 330 is abutted on the second positioning protrusion 130, and the insertion plates 311 are abutted on a side of the first retaining portion 111 located away from the second retaining portion 112 of the retaining groove 110. That is, the end of the first retaining portion 111 and the second positioning protrusion 130 can limit the movable range of the elastic engaging component 300 in an insertion direction.

In this embodiment, the quantity of the bent parts 320 are exemplary and not intended to limit the present disclosure. In some embodiments, the elastic engaging component may only include one bent part.

The engaging parts 340 are located at a side of the arm part 330 located away from the mount part 310. The engaging parts 340 are movable with respect to the mount part 310 along with the arm part 330. The engaging parts 340 are engageable with the slots 210 of the second electrical connector 200.

In this embodiment, the quantities of the engaging parts 340 and the slots 210 are exemplary and not intended to limit the present disclosure. In some embodiments, the elastic engaging component may only include one engaging part, and the second electrical connector may only include one slot.

In this embodiment, the elastic engaging component 300 further includes a curved part 350. The press part 360 is connected to the arm part 330 via the curved part 350. Thus, the curved part 350 and the arm part 330 can be moved with respect to the mount part 310 by pushing the press part 360. In FIG. 5, a distance D2 between the press part 360 and the insertion plates 311 is longer than a distance D1 between the arm part 330 and the insertion plates 311.

In this embodiment, the movable plate 312 may further include two stamped structures 3121 protruding towards the press part 360 from the movable plate 312 to limit a movable range of the press part 360. In addition, each of the stamped structures 3121 has a recess located opposite to the press part 360 for human fingers to lift the edge of the movable plate 312 towards the press part 360.

In this embodiment, the press part 360 may further include two reinforcement structures 361 protruding outwards from the outer surface of the press part 360. The reinforcement structures 361 are configured to enhance the structural strength of the press part 360 and to provide an anti-slip effect while the human finger is pushing the press part 360, providing a better user experience.

The elastic engaging component 300 further includes two extension tab parts 370 and two curved parts 380. The extension tab parts 370 are connected to the press part 360 respectively via the curved parts 380. In FIG. 5, a distance D3 between the extension tab parts 370 and the insertion plates 311 is shorter than the distance D2 between the press part 360 and the insertion plates 311. The extension tab parts 370 are movably located in the second retaining portion 112 of the retaining groove 110 so as to limit the movable range of the press part 360 with respect to the mount part 310, preventing the bent parts 320 from being overly deformed.

In this embodiment, the quantities of the extension tab parts 370 and the curved parts 380 are exemplary and not intended to limit the present disclosure. In some embodiments, the elastic engaging component may only include one extension tab part and one curved part.

Figure 6:
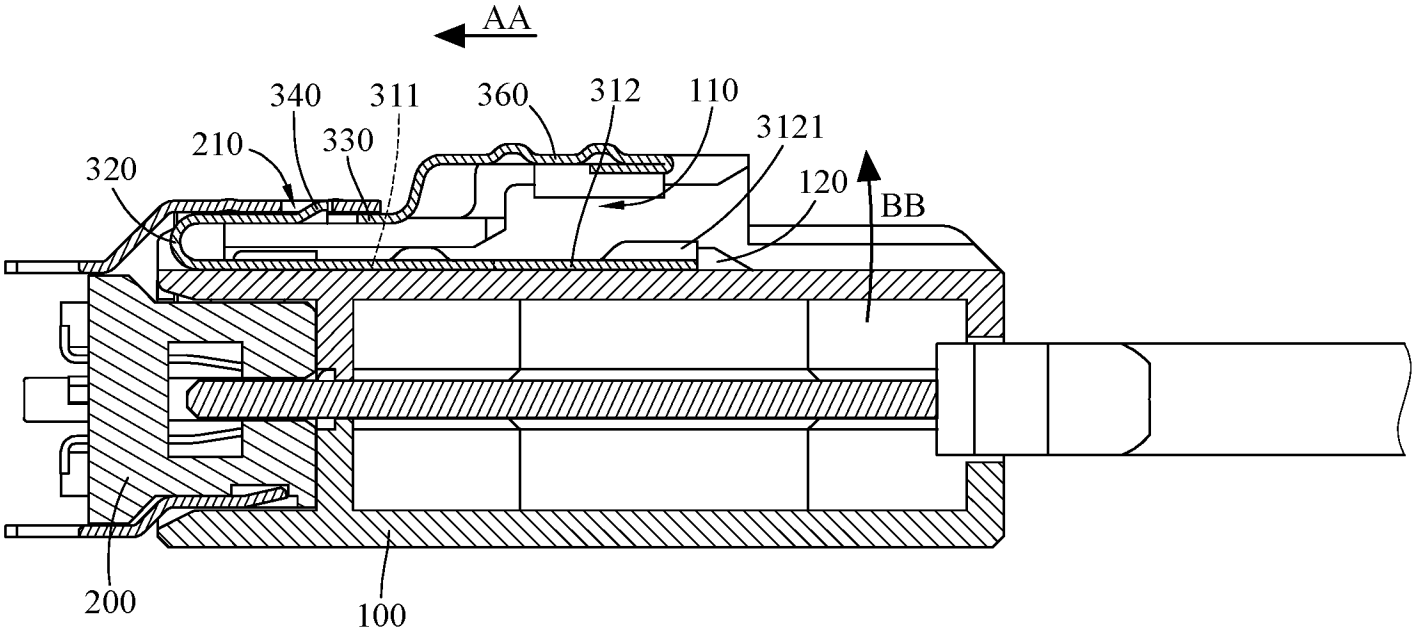
FIG. 6 to FIG. 8 show the process of plugging the connector assembly in FIG. 1.
Figure 7:
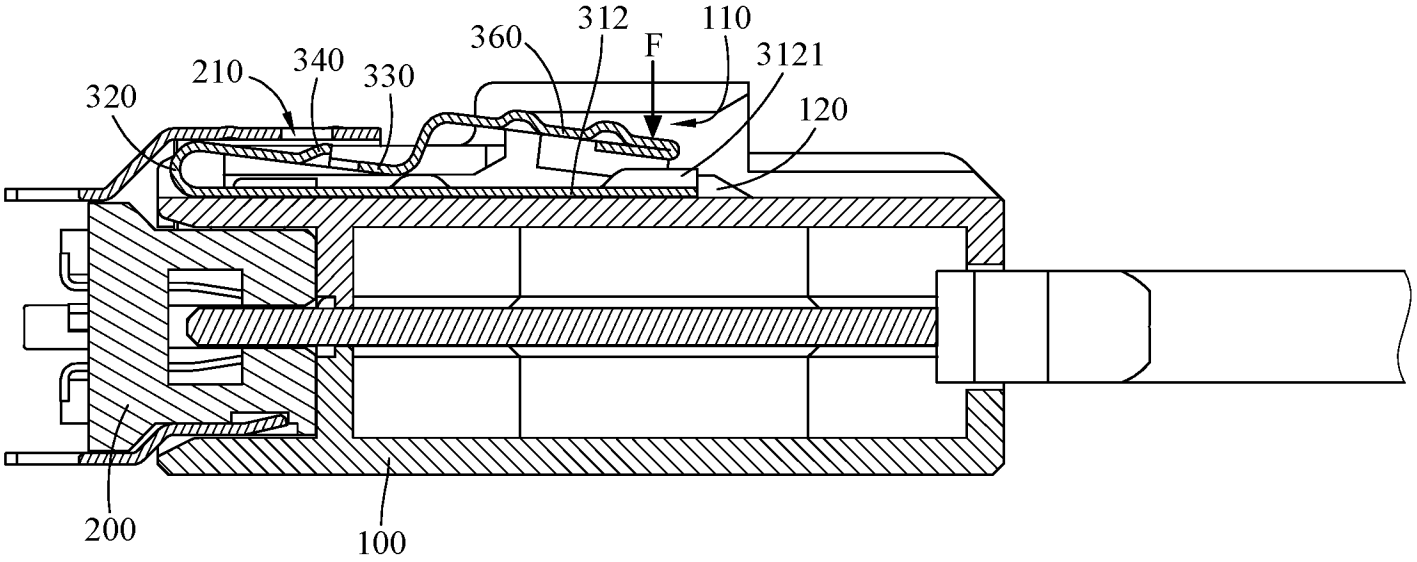
Figure 8:
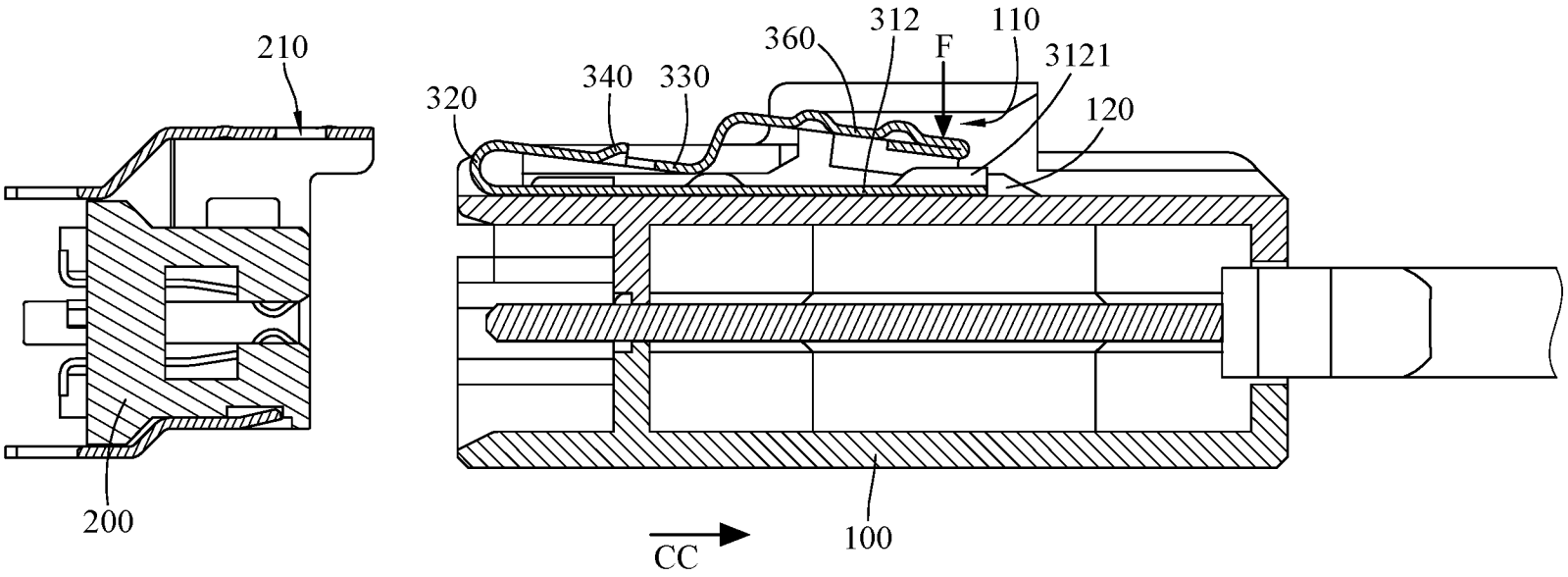

Please refer to FIG. 6 to FIG. 8, the process of plugging the connector assembly 10 is provided.

Firstly, as shown in FIGS. 2 and 6, the insertion plates 311 are being inserted into the retaining groove 110 in a direction AA, during this movement, the movable plate 312 is deformed and moved with respect to the insertion plates 311 in a direction BB by being pushed by the first positioning protrusion 120. When the insertion plates 311 reach a predetermined position (as shown in FIG. 6), the movable plate 312 returns to its original position in a direction opposite to the direction BB and is held by the first positioning protrusion 120 of the first electrical connector 100. That is, the movable plate 312 is removably held by the first positioning protrusion 120. At this moment, the movable plate 312 is still allowed to be released from the first positioning protrusion 120 by being moved in the direction BB; by doing so, the elastic engaging component 300 can be detached from the first electrical connector 100.

As shown in FIG. 6, the first electrical connector 100 is plugged into the second electrical connector 200, and the engaging parts 340 of the elastic engaging component 300 are engaged with the slots 210 of the second electrical connector 200 as the arm part 330 returns to its original position. The engagement of the engaging parts 340 and the slots 210 secures the connection between the first electrical connector 100 and the second electrical connector 200.

As shown in FIG. 7, the first electrical connector 100 is released from the second electrical connector 200, as shown, the press part 360 is moved towards the mount part 310 by an external force F so that the arm part 330 and the engaging parts 340 thereon are move towards the mount part 310 as well. By doing so, the engaging parts 340 are removed from the slots 210 of the second electrical connector 200 and thus disengaging the elastic engaging component 300 from the second electrical connector 200.

While the press part 360 is moved towards the mount part 310, the stamped structures 3121 of the movable plate 312 of the mount part 310 can limit the movable range of the press part 360 with respect to the mount part 310, preventing the bent parts 320 from being overly deformed.

Further, as shown in FIG. 8, the first electrical connector 100 is moved in a direction CC so as to be unplugged from the second electrical connector 200.

Figure 9:
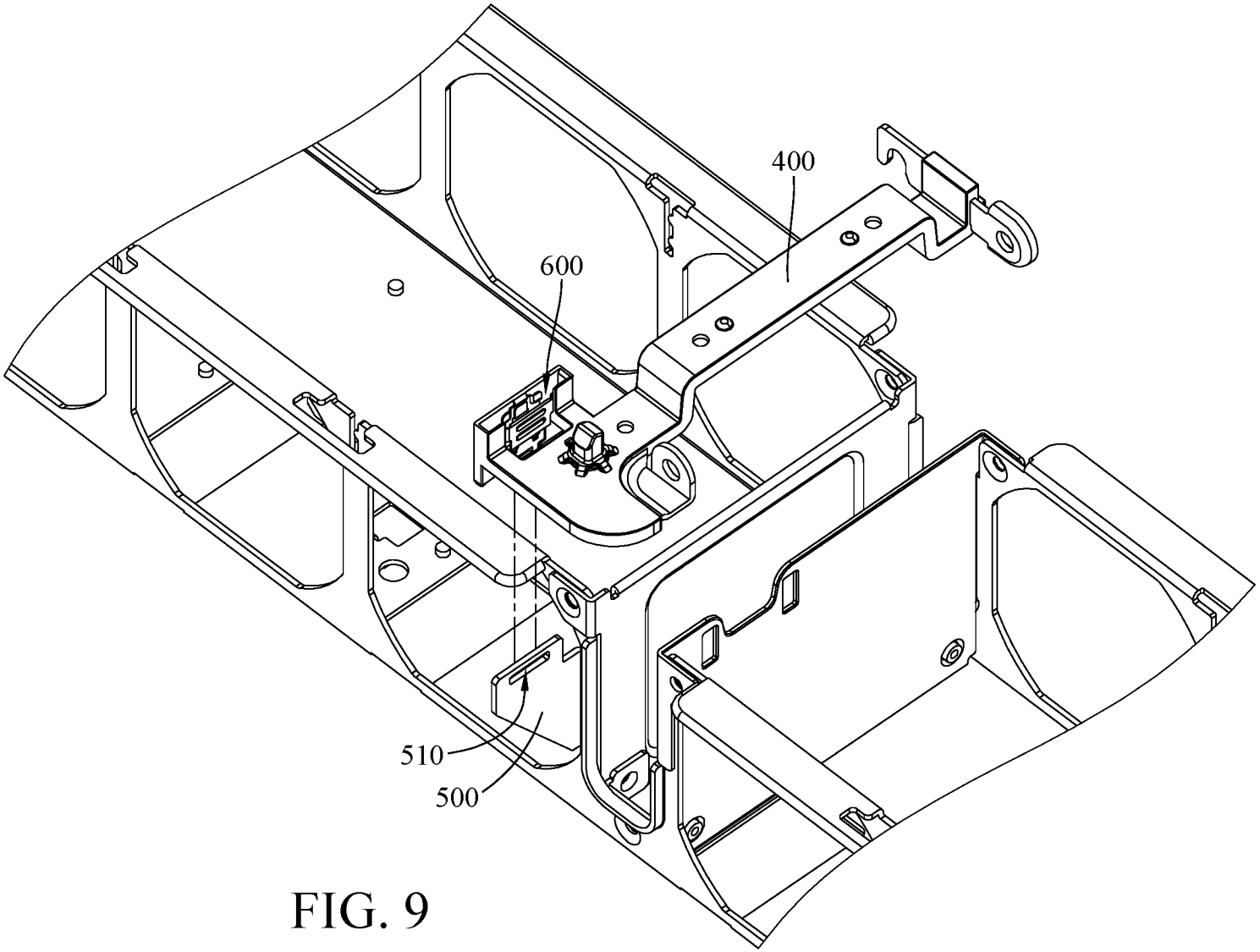
FIG. 9 is an exploded view of an elastic engaging component, a first mechanical component and a second mechanical component according to a second embodiment of the present disclosure.

The abovementioned elastic engaging component 300 is exemplary and can be applied to other mechanisms having two pieces that are engageable with each other. Please refer to FIG. 9, which is an exploded view of an elastic engaging component, a first mechanical component and a second mechanical component according to a second embodiment of the present disclosure.

In this embodiment, the structure of an elastic engaging component 600 is similar to that of the elastic engaging component 300 of the first embodiment. The elastic engaging component 600 is fixed to a first mechanical component 400 and engageable with a slot 510 of a second mechanical component 500. Accordingly, the first mechanical component 400 can be assembled to the second mechanical component 500 via the elastic engaging component 600. In this embodiment, the first mechanical component 400 is, for example, a handle mounted on a fan frame, and the second mechanical component 500 is, for example, the fan frame.

According to the connector assembly and the elastic engaging component discussed above, since the movable plate can be retained by the first positioning protrusion of the first electrical connector when no external force is applied thereon, the elastic engaging component is engageable with the first mechanical component or the first electrical connector.

Further, since the stamped structures has a recess located opposite to the press part for human fingers to lift the edge of the movable plate towards the press part, the elastic engaging component is convenient to use; since the extension tab parts and the stamped structures can limit the movable range of the press part with respect to the mount part, preventing the bent parts of the elastic engaging component from being overly deformed, such that the elastic engaging component can achieve a reliable connection for the connector assembly.

Furthermore, the engagement of the engaging parts and the slots can secure the connection between the first electrical connector and the second electrical connector. In addition, the abovementioned elastic engaging component can be designed in a small size and also convenient to use.

In one embodiment of the present disclosure, the connector assembly and the elastic engaging component of the present disclosure can be applied to a server that may be used for artificial intelligence (AI) computing, edge computing or can be used as a 5G server, a cloud server or a server for internet of vehicles.

The embodiments are chosen and described in order to best explain the principles of the present disclosure and its practical applications, to thereby enable others skilled in the art best utilize the present disclosure and various embodiments with various modifications as are suited to the particular use being contemplated. It is intended that the scope of the present disclosure is defined by the following claims and their equivalents.

What is claimed is:

1. A connector assembly, comprising:

a first electrical connector, comprising a retaining groove and a first positioning protrusion, wherein the first positioning protrusion is located adjacent to an opening of the retaining groove; and a second electrical connector, detachably plugged to the first electrical connector, wherein the second electrical connector comprises a slot; and an elastic engaging component, comprising:

a mount part, comprising an insertion plate and a movable plate, wherein the insertion plate is configured to be inserted into the retaining groove of the first electrical connector, and the movable plate is connected to a side of the insertion plate; while the insertion plate is inserted into the retaining groove, the movable plate is configured to be deformed and moved with respect to the insertion plate by being pushed by the first positioning protrusion; when the insertion plate reaches a predetermined position, the movable plate is configured to return to an original position thereof and to be held by the first positioning protrusion of the first electrical connector or to be released from the first positioning protrusion by an external force to release a restriction relationship between the movable plate and the first positioning protrusion of the first electrical connector;

a bent part, an arm part, connected to the mount part via the bent part, wherein the arm part is located at a side of the bent part where the mount part is located;

an engaging part, wherein the engaging part is located at a side of the arm part located away from the mount part, the engaging part is movable with respect to the mount part along with the arm part, and the engaging part is configured to be engageable with the second electrical connector; and a press part, wherein the press part is connected to a side of the arm part located away from the bent part, and the arm part is movable with respect to the mount part by pushing the press part.

2. The connector assembly according to claim 1, wherein the retaining groove comprises a first retaining portion and a second retaining portion, the first retaining portion is smaller than the second retaining portion in height, the mount part further comprises a folded plate connected to and overlapping with the insertion plate, the folded plate and the insertion plate have a thickness substantially equal to the height of the first retaining portion of the retaining groove, and the elastic engaging component further comprises an extension tab part connected to the press part and movably located in the second retaining portion of the retaining groove.

3. The connector assembly according to claim 2, wherein the insertion plate comprises a bump structure protruding towards the arm part from a surface of the insertion plate, and a height of the bump structure is substantially equal to the height of the first retaining portion of the retaining groove.

4. The connector assembly according to claim 2, wherein the elastic engaging component further comprises a curved part, the extension tab part is connected to the press part via the curved part, and a distance between the extension tab part and the insertion plate is shorter than a distance between the press part and the insertion plate.

5. The connector assembly according to claim 1, wherein the movable plate further comprises a stamped structure protruding towards the press part from the movable plate to limit a movable range of the press part.

6. The connector assembly according to claim 1, wherein the elastic engaging component further comprises a curved part, the press part is connected to the arm part via the curved part, and a distance between the press part and the insertion plate is longer than a distance between the arm part and the insertion plate.

7. An elastic engaging component, configured to assemble a first mechanical component to a second mechanical component, and the elastic engaging component comprising:

a mount part, comprising an insertion plate and a movable plate, wherein the insertion plate is configured to be inserted into a retaining groove of the first mechanical component, the movable plate is located at a side of the insertion plate, the movable plate is movable with respect to the insertion plate, and the movable plate is configured to be held by the first mechanical component or to be released from the first mechanical component to release a restriction relationship between the movable plate and the first mechanical component;

a bent part;

an arm part, connected to the mount part via the bent part, wherein the arm part is located at a side of the bent part where the mount part is located;

an engaging part, located at the arm part, the engaging part is movable with respect to the mount part along with the arm part, and the engaging part is configured to be engageable with the second mechanical component; and a press part, wherein the press part is connected to a side of the arm part located away from the bent part, and the arm part is movable with respect to the mount part by pushing the press part.

8. The elastic engaging component according to claim 7, wherein the mount part further comprises a folded plate overlapping with the insertion plate.

9. The elastic engaging component according to claim 8, wherein the insertion plate comprises a bump structure protruding towards the arm part from a surface of the insertion plate, and a height of the bump structure is substantially equal to a thickness of the folded plate and the insertion plate.

10. The elastic engaging component according to claim 7, wherein the elastic engaging component further comprises an extension tab part and a curved part, the extension tab part is connected to the press part via the curved part, and a distance between the extension tab part and the insertion plate is shorter than a distance between the press part and the insertion plate.

* * * * *